United States Patent [19]

Huang

[11] Patent Number: 4,890,006

[45] Date of Patent: Dec. 26, 1989

[54] ROTARY LOCK SWTICH FOR SWITCHING AND RESETTING A COMPUTER

[76] Inventor: Chao-Kuei Huang, No. 6, Lane 5, Chung Yang Rd., Tai Shan Hsiang, Taipei Hsien, Taiwan

[21] Appl. No.: 241,239

[22] Filed: Sep. 7, 1988

Related U.S. Application Data

[63] Continuation-in-part of Ser. No. 73,702, Jul. 15, 1987, abandoned.

[51] Int. Cl.[4] ..... H01H 21/68; H01H 27/06

[52] U.S. Cl. ..... 307/112; 206/11 C; 206/43.04; 206/43.08; 364/709.1

[58] Field of Search ..... 200/11 R, 11 C, 11 G, 200/1 U, 11 K, 43.01–43.08; 307/112; 341/17; 364/709.01, 709.09, 709.12, 709.14–709.16

[56] References Cited

U.S. PATENT DOCUMENTS

| | | | |
|---|---|---|---|
| 3,974,348 | 8/1976 | Lipschutz | 200/11 C X |
| 4,023,161 | 5/1977 | Sasaki | 200/43.06 |
| 4,527,024 | 7/1985 | Lai | 200/11 C |
| 4,634,822 | 1/1987 | Goeke | 200/43.08 |

*Primary Examiner*—J. R. Scott

*Attorney, Agent, or Firm*—Steinberg & Raskin

[57] ABSTRACT

A computer lock switch for a computer operable by a key to switch among an OFF position, and ON position and a RESET position to respectively switch off or switch on a power supply for the computer, and to reset the computer. The ON position is located between the OFF position and the RESET position, with a restorative device being provided for urging the key inserted into the computer switch lock from the RESET position to the ON position.

4 Cl

ROTARY LOCK SWTICH FOR SWITCHING AND RESETTING A COMPUTER

BACKGROUND OF THE INVENTION

This application is a continuation-in-part of U.S. patent application Ser. No. 07/073,702, filed July 15, 1987, now abandoned.

This invention relates to a computer lock switch for switching the power supply thereof on or off and resetting a computer.

Conventional computer lock switches are similar to the ignition switch of a car. When a correct key is inserted into the lock switch and turned from its off position to its ON position, the power source is connected. A practical computer lock switch is shown in FIGS. 7 and 8. The lock switch has two terminals A1 and A2 to connect with the power source. Like the ordinary cylinder locks, it has a housing A, and a first rotor B mounted in a seat E. When the first rotor B is turned by the key to a correct angle, i.e. to the ON position, the two terminals A1 and A2 are electrically connected. Like conventional cylinder locks, the rotor B carries a plurality of spring-loaded pin-tumbler sets. Each set comprises a pin C, a tumbler D, and a spring F. The key is provided with a plurality of recesses G, of which the upper end forms a shoulder G1. When the correct key is inserted into the lock, the shoulders G1 will push the pins C to a correct distance so that the junctions of the pins C and tumblers D are all in alignment with the upper margin E1 of the seat E, thus making the rotation of the rotor B in the lock switch possible. In other words, the rotor B can be driven by the key to co-rotate in the lock. In so doing, a second rotor H is driven by the first rotor to co-rotate in the lock, and the two contacts I1 and I2, which are interconnected by a conducting piece J and which are fixed on the second rotor H, are rotated to an ON position where they respectively contact terminals A1 and A2. Thus the two terminals A1 and A2 are electrically connected, and the power of the computer is switched on. Thus one end of the first rotor B is engagable with the key and the opposite end of the rotor B is engagable with one end of the second rotor H which carries the two contacts $A_1$ and $A_2$ at an opposite end thereof, as illustrated in FIG. 7. In order to keep the contacts I1 and I2 in good contact with the terminals A1 and A2, a spring K is provided to resiliently bias the second rotor H, and therefore bias the contacts I1 and I2, toward the terminals A1 and A2. To reduce the wear of the spring during the rotation of the rotor B, a bush L is provided. FIG. 8 shows the appearance of the lock. When the key is inserted into the lock and turned from ON position to OFF position, the power is switched on. The key has a projection G2. The keyhole of the lock switch has a notch G3 in its OFF position. Thus the key can only be inserted or removed in its OFF position, but not in its ON position.

Computer operators may sometimes carelessly undesirably touch the reset button on the keyboard of a computer, so that the computer returns to its original status, and all the keyed-in information is lost.

Accordingly it is the object of this invention to provide a lock switch for a computer of which the resetting is also controlled by the same key for switching on its power source.

According to the present invention, the lock switch has, besides ON and OFF positions, a resetting position. Only when the key is turned to RESET or the resetting position can the resetting function be actuated. Of course, the resetting key is cancelled from the keyboard or the resetting key is disabled. Accordingly, the risk of undersired touch of any active resetting key on a keyboard can be avoided.

This invention will be better understood when read in connection with the accompanying drawings, in which:

DETAILED DESCRIPTION OF THE PREFERRED EMBODIMENT

Figure 1:
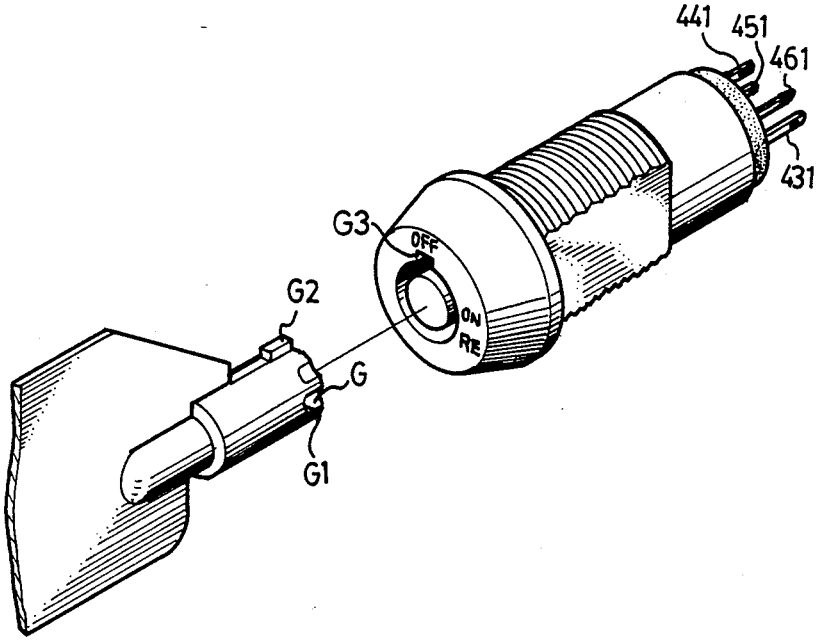
FIG. 1 is a perspective view of a computer lock switch according to this invention.
Figure 2A:
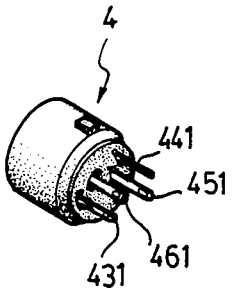
FIGS. 2A and 2B are the perspective views of the terminal seat of this invention.
Figure 2B:
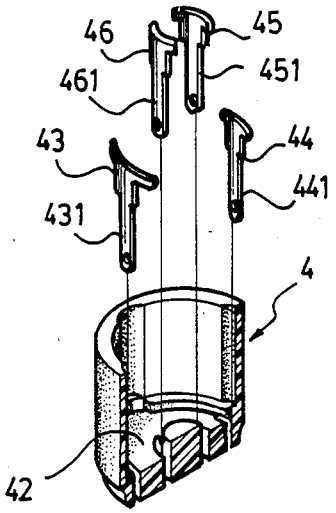
Figure 7:
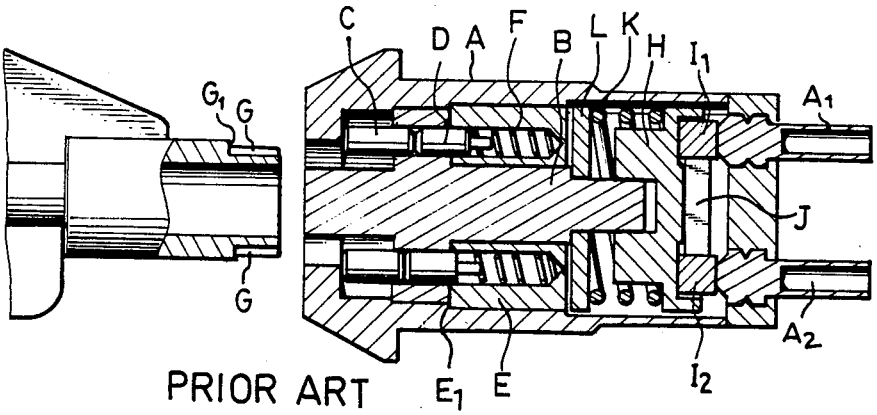
PRIOR ART FIG. 7
FIG. 7 is a longitudinal sectional view of a known computer lock switch and key.
Figure 8:
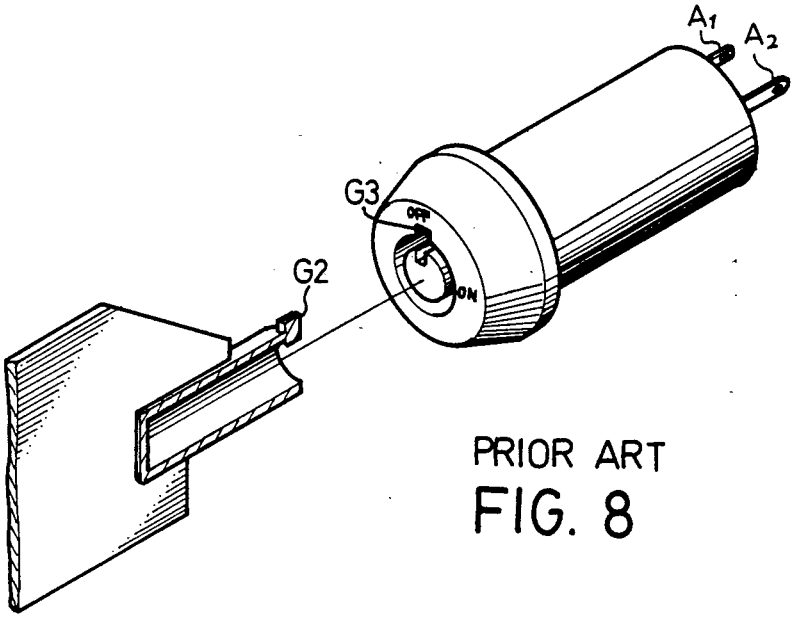
PRIOR ART FIG. 8
FIG. 8 is a perspective view of the known computer lock and key in FIG. 7.

Referring to FIG. 1, the computer lock switch is operated by a key which is exactly the same as the key for the conventional computer lock switch in FIG. 7 and which also is provided with recesses G, shoulders G1, and a projection G2. Since all the parts from the keyhole of the computer switch lock to the bush thereof are the same as the prior art in FIG. 7, the details of the parts can be omitted. Unlike a conventional computer lock switch, the lock switch according to this invention has a RESET or resetting position RE in addition to OFF and ON positions, and its terminal seat 4, which is made by insulating material, carries four terminals 431, 441, 451, and 461 instead of two. When the key is turned to the RE position, the result is the same as that when the reset button of a conventional keyboard is touched.

Figure 3:
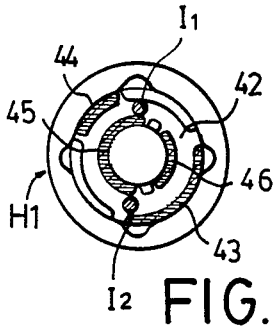
FIGS. 3 to 5 respectively show the the positions of the two contacts in OFF, ON and resetting state of a lock switch according this invention.
Figure 4:
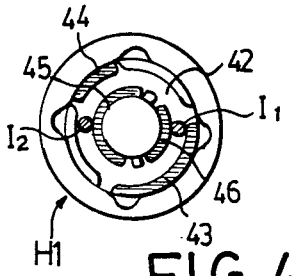
Figure 5:
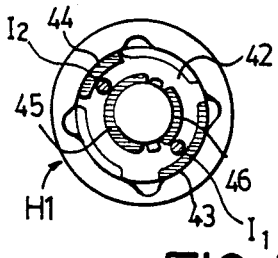
Figure 9:
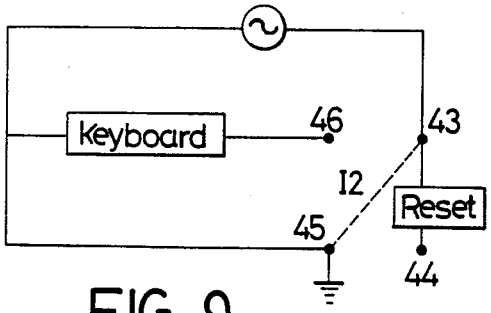
FIGS. 9 to 11 are the circuit diagrams showing the connection in OFF, ON and RESET position.
Figure 10:
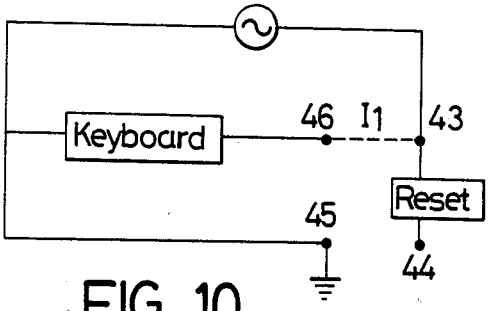
Figure 11:
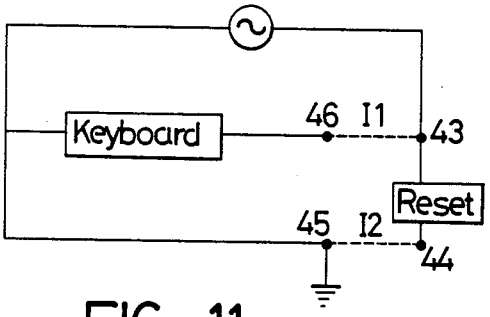
Figure 12:
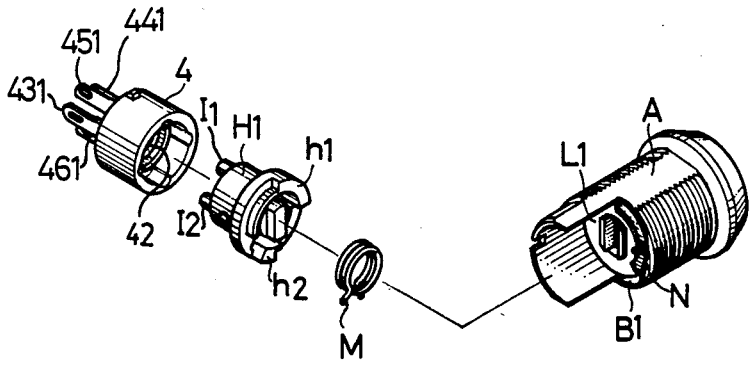
FIG. 12 is a partially exploded and dismantled view of the switch of this invention.

Referring to FIG. 3 to FIG. 5, the inside of the terminal seat has an annular groove 42, in which the two contacts I1 and I2 are received. Unlike the prior art, the two contacts here are not interconnected by a conducting piece J but are electrically insulated with each other. The respective fixed end of each terminal 431, 441, 451 and 461 is arcuated to define an arcuated track 43, 44, 45 and 46. Terminal 431 is connected to the power source, terminal 441 is connected to the reset circuit of a computer provided with the lock switch of the invention, terminal 451 is connected to the grounding line, and terminal 461 is connected to the keyboard. Referring to FIG. 3 and FIG. 9, when the key is not inserted or kept in the OFF position, no tracks are interconnected or only tracks 43 and 45 are interconnected by contact I2. The keyboard is not energized, so the computer is in OFF state. In FIG. 4 and FIG. 10, when the key is turned to ON position, tracks 43 and 46 are interconnected by contact I1. Thus the keyboard is energized and available for use. In FIG. 5 and FIG. 11, when the key is turned to RESET or the resetting position, tracks 43 and 46 are interconnected by contact I1, whereas tracks 44 and 45 are interconnected by contact I2. Thus both the keyboard and the reset circuit are energized. As a result the resetting function is actuated.

Figure 6:
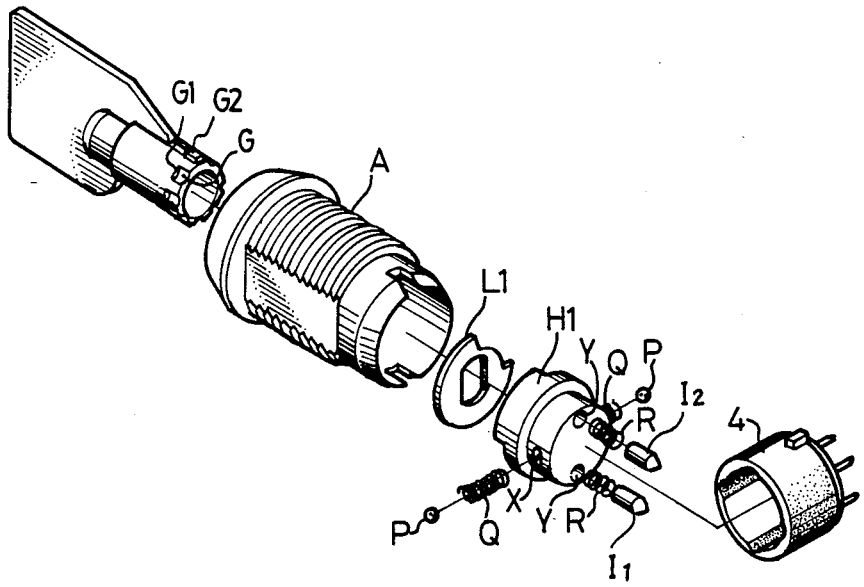
FIG. 6 is a fragmentary view of the lock switch according to this invention.

It is very easy in lock technique to provide a third position to actuate the resetting function. FIG. 6 shows a feasible example of the interior structure of a lock switch in accordance with the present invention. Structurally, it is similar to the conventional lock switch in FIG. 7, so its detailed description can be reduced to minimum. But in the prior art, the lock has two stable positions; ON and OFF, while in the present invention, the lock has an additional RESET position. Preferably, the RESET position is unstable, and the rotor in RESET position is subject to a resumptive force to bias it toward its ON position. The resumptive force is produced by a torsion spring. Referring to FIG. 12 and FIGS. 13A to 13C, the first rotor B1 is received in the housing A. It is structurally the same as the first rotor D of the prior art in FIG. 7. The bush L1 is driven by the first rotor B1 to co-rotate in the housing A. A stop pin N is fixed in the housing A to limit the rotation angle of the first rotor between its OFF and RESET position. The second rotor H1 has two protuberances h1 and h2. A torsion spring M is fixed in the second rotor H1.

Figure 13A:
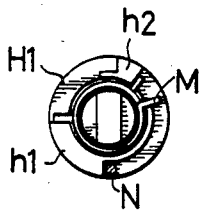
FIGS. 13A to 13C are the graphical representation showing the position of a pin and a spring in ON, OFF and RESET position.
Figure 13B:
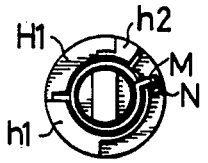
Figure 13C:
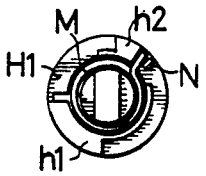

Reference is made to FIGS. 13A to 13C. In FIG. 13A, the first rotor B1 is in its OFF position. When the first rotor B1 is turned to its ON position in FIG. 13B, the second rotor H1 is also driven to co-rotate in the housing A, and therefore in the terminal seat 4 which is fixed to the housing. In FIGS. 13A and 13B, the torsion spring M is not stressed. In FIG. 13A, stop pin N is in contact with the protuberance h1. When the user turns the key to the ON position in FIG. 13B, the stop pin N will touch an arm of the torsion spring M but does not stress the latter. When the user further turns the key to the RESET position in FIG. 13C, the arm of the torsion spring M is pushed to the protuberance h2 by the stop pin N, so the torsion spring is stressed. Thus there is a resumptive force which forces the rotor B from its RESET position to its ON position. Accordingly, when the user releases the effort, the key will be biased from RESET position to ON position.

Like the conventional lock switch, this invention also has a notch G3 in its keyhole. The inserted key can only be drawn out in its OFF position but not in its ON position.

The second rotor H1 has two balls P which are biased by springs Q received in recesses X. The interior of the housing A is provided with corresponding recesses, which are not shown, into which the balls P can be pushed when the second rotor H1 is rotated to some specific positions for example, ON and OFF positions. thus offering the user a feeling of the two positions. Since this is well known structure, its detailed description is not necessary.

The two contacts I1 and I2 are biased by springs R received in recesses Y toward the tracks 43, 44, 45 and 46 to ensure its good contact with the tracks. Since this is also well known structure, it detailed description can be omitted.

I claim:

1. A lock switch for a computer, said lock switch being operable by a key turnable between an OFF position and an ON position to respectively switch off and switch on a power supply for said computer, said lock switch being structured such that said key can only be inserted only into said lock switch or removed therefrom when said key is in said off position, wherein said lock switch is structured to define a RESET position to which said key can be turned, a reset function of said computer only being actuatable when said key is turned to said RESET position, said ON position being positioned between said OFF position and said RESET position, and said lock switch being provided with spring means for biasing said key from said RESET position to said ON position.

2. The lock switch according to claim 1, wherein said lock switch further comprises:

a terminal seat;

a first rotatable member, one end of which is engagable with the key;

a second rotatable member, one end of which is engaged with another end of said first rotatable member, and another end of which is rotatably received in said terminal seat and carries two contacts which are electrically insulated;

said terminal seat being provided with first terminal means, second terminal means, third terminal means, and fourth terminal means which are insulated from one another and which are respectively connected to a power supply, a reset circuit, a grounding line, and a keyboard of said computer;

said terminal means being structured and positioned such that (i) when said key is in said OFF position, said second contact electrically interconnects said first and said third terminal means;

(ii) when said key is in said ON position, said first contact electrically interconnects said first and said fourth terminal means; and (iii) when said key is in said RESET position, said first contact electrically interconnects said first and said fourth terminal means, while said second contact electrically interconnects said second and said third terminal means.

3. The lock switch according to claim 2, wherein said terminal seat is provided with an annular groove in which said two contacts are received, each of said terminal means having a fixed end which is arcuate in shape and situated on one of an inner side and an outer side of said groove.

4. The lock switch according to claim 3, wherein the fixed end of said first and second terminal means are situated on the outer side of said grooves while the fixed ends of said third and fourth terminal means are situated on the inner side of said groove.

* * * * *